US005583488A

United States Patent [19]

Sala et al.

[11] Patent Number: 5,583,488

[45] Date of Patent: Dec. 10, 1996

[54] PROXIMITY ALARM SYSTEM

[76] Inventors: Nicola R. Sala, 61 Hyannis Avenue, Nepean, Ontario, Canada, K2J 3G2; Rocco L. Sala, 62 Palsen Street, Nepean, Ontario, Canada, K2G 2W4

[21] Appl. No.: 430,232

[22] Filed: Apr. 28, 1995

[51] Int. Cl.[6] ..... G08B 21/00

[52] U.S. Cl. ..... 340/568; 340/505; 340/539; 342/125; 342/127

[58] Field of Search ..... 340/568, 539, 340/505; 342/125, 127

[56] References Cited

U.S. PATENT DOCUMENTS

| | | | |
|---|---|---|---|
| 4,804,961 | 2/1989 | Hane | 342/125 |
| 5,021,765 | 6/1991 | Morgan | 340/539 |
| 5,043,702 | 8/1991 | Kuo | 340/539 |
| 5,402,104 | 3/1995 | LaRosa | 340/568 |

*Primary Examiner*—Glen Swann
*Attorney, Agent, or Firm*—Michael M. Sakovich

[57] ABSTRACT

The spatial separation of an object from a reference location is monitored utilizing a proximity alarm system which comprises a transceiver station mounted on the object and a repeater station at the reference location. Both stations function to generate and transmit an encoded rf signal in a half-duplex manner, with the transceiver station initiating the process. In one embodiment of the system, a phase delay is measured between a remote signal originating at the transceiver station and a corresponding decoded timing signal received from the repeater station. Correlation of the phase delay with a reference value ascertains the distance between the stations and an alarm at the transceiver station is actuated when the distance exceeds a predetermined value. A second embodiment of the system employs a clock driven counter that is stopped when a predetermined multiple of decoded timing signals is received at the transceiver station in response to iterative transmissions therefrom. The count value of the counter is read and correlated with a transit time reference value to ascertain the distance between stations. An alarm is actuated if the distance exceeds a predetermined maximum.

20 Claims, 5 Drawing Sheets

PROXIMITY ALARM SYSTEM

FIELD OF THE INVENTION

The present invention relates to an alarm system for preventing the inadvertent loss or intentional theft of personal property and more particularly to an alarm system in which movement of the protected property is continually monitored.

BACKGROUND OF THE INVENTION

Loss of personal possessions such as billfolds, purses, luggage and carrying cases generally, is a common occurrence through accident, inadvertence or outright theft. For example, crowded conditions at air terminals, train and bus depots, and the like, create conditions where confusingly similar luggage may be taken in error. These same conditions promote confusing situations where items of luggage are often misplaced and the attraction of certain expensive items such as cameras, sports equipment, or other personal possessions, including wearing apparel, is conducive to theft.

In recognition of the problem, known apparatus and systems have been devised to monitor the spatial relationship of an item to be protected with respect to a base station carried by an individual. A typical system is disclosed in U.S. Pat. No. 5,043,702 Kuo in which one embodiment thereof employs a radio frequency receiver disposed within an item of luggage. A corresponding transmitter is carried by the user and when the distance between the user and the luggage exceeds about ten to fifteen meters, a reduction in signal strength at the receiver is sensed which actuates an alarm and additionally electrifies a grid that is intended to deliver an electrical shock to the person carrying the luggage. Another example may be seen in U.S. Pat. No. 5,021,765 Morgan which relates to apparatus and a method for detecting the situation of a person falling overboard from a boat. An individual protected by the system carries a low frequency transmitter which is actuated when wet. To prevent spurious responses, a system of at least two detectors on the boat actuates an alarm when both the low frequency signal is transmitted and the person carrying the transmitter is outside a predetermined range of the detectors which is indicated when one detector output is substantially less than that of the other detector.

Both Kuo and Morgan are similar in that their respective disclosures rely on a reduction of received signal amplitude to indicate a spatial relationship of the item or person to be protected, as the case may be, with respect to a reference.

Such systems clearly have merit since they will perform adequately under most conditions. There are, however, situations in which the teachings of both Kuo and Morgan are inadequate. For example, a broad spectrum of electrical noise may mask the signal received by the receiver of Kuo such that regardless of the receiver distance from the transmitter carried by the individual, Kuo's receiver continues to sense a masking noise signal of substantially constant amplitude. Under these conditions the alarm would not be actuated.

A similar situation may occur in the case of the protective system disclosed by Morgan in that a strong interference signal may mask the output of the low frequency transmitter carried by an individual such that the two or more detectors may not sense any variation in signal level should the protected individual move out of a predetermined range from the detectors.

It becomes apparent, therefore, that any system relying on the detection of reduced signal strength of a received low level transmitted signal is subject to deception imposed by strong, broad band interference or noise signals; both are expected to be prevalent in those environments where a protection system is often most needed.

SUMMARY OF THE INVENTION

A principal objective of the present invention is the provision of a proximity alarm system in which signal timing methods are employed to ascertain the spatial relationship of a protected object with respect to a central reference.

Another objective of the invention is the disclosure of a method for operating a proximity alarm system in which the spatial relationship between a protected object and a central reference utilizes either phase delay or transit time measurements of signals transmitted between the object and the central reference.

Still another objective of the invention is the provision of a proximity alarm system that is operable utilizing either a radio frequency or ultrasonic carrier signal.

A further objective of the invention is the provision of a proximity alarm system in which signal transmission between a transceiver station and a spatially separated repeater station occurs in a half-duplex transmission mode.

The problems associated with the prior art may be substantially overcome and the foregoing provisions achieved by recourse to the invention which, in one aspect thereof, relates to a proximity alarm system. The system comprises, in combination, a transceiver station having signal receiver means, and circuit means for generating and transmitting a remote signal, a repeater station spatially separated from the transceiver station, including means for receiving the remote signal, means operably responsive to a predetermined state of the received remote signal for generating and transmitting a timing signal for reception at the transceiver station, and discriminator means for detecting a time delay between the remote and timing signals at the transceiver station and generating a time shift value in response thereto corresponding to the spatial separation between the transceiver and repeater stations.

Another aspect of the invention relates to a method for operating a proximity alarm system. The method comprises the steps of, generating a remote signal at a transceiver station and transmitting the signal therefrom to a remotely located repeater station, receiving the remote signal at the repeater station, generating a timing signal at the repeater station in response to a predetermined first state of the received remote signal, transmitting the timing signal from the repeater station in response to a predetermined second state of the received remote signal, and detecting a time difference between the remote signal generated and the timing signal received at the transceiver station, and activating an alarm when a predetermined time difference is exceeded.

BRIEF DESCRIPTION OF THE DRAWINGS

The invention will now be more particularly described with reference to embodiments thereof shown, by way of example, in the accompanying drawings in which.

DETAILED DESCRIPTION OF THE PREFERRED EMBODIMENTS

The embodiments of the invention hereinbelow disclosed rely on block diagrams to describe certain apparatus and various circuit elements together with their respective functions. These diagrams therefore represent hardware features that would be known to those skilled in the art to whom this specification is addressed, although not in the novel combinations disclosed. Accordingly, the following constitutes a sufficient description to such individuals for a comprehensive understanding of the best mode to give effect to the embodiments disclosed and claimed herein.

Figure 1:
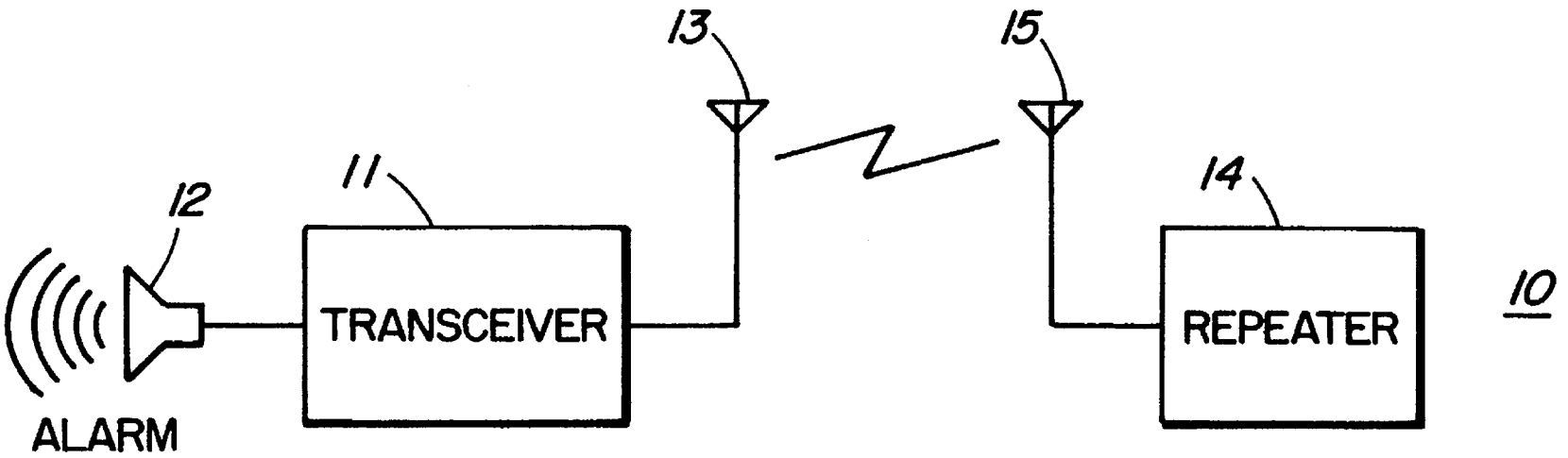
FIG. 1 is a block diagram of a basic proximity alarm system in accordance with the present invention.

FIG. 1 illustrates a basic proximity alarm system 10 in accordance with the invention wherein a transceiver station, referred to herein as a transceiver 11, including an attendant alarm 12, is disposed upon or within an object to be protected. As indicated in greater detail in FIG. 2, the transceiver 11 typically includes circuit means for generating and transmitting an encoded rf output carrier signal, referred to herein as a remote signal, as well as corresponding circuit means for receiving an rf timing signal which will be described in greater detail in the description to follow. The remote signal is coupled from an output of the transceiver 11 to an antenna 13 that is used both for transmission and reception of rf signals.

A second transceiver station, shown as a repeater 14 having an antenna 15, is spatially separated from the transceiver 11 and is adapted to process the encoded remote signal received therefrom. Described in greater detail hereinbelow, the repeater 14 monitors the remote signal from the transceiver 11 and returns a timing signal for ascertaining the distance between the two stations of the system 10. Should the spatial separation become greater than a predetermined threshold established at the transceiver 11, the alarm 12 is actuated and draws attention to illegal movement of the protected object.

According to the invention, the remote signal traversing the distance between the antennas 13 and 15 is monitored to detect and measure either a shift in phase or change in transit time of the encoding signal with respect to a reference signal as will be described in greater detail hereinbelow. In either event, a time reference is established which is correlated with the rate of the remote signal propagation to establish the separation distance between the stations.

Figure 2:
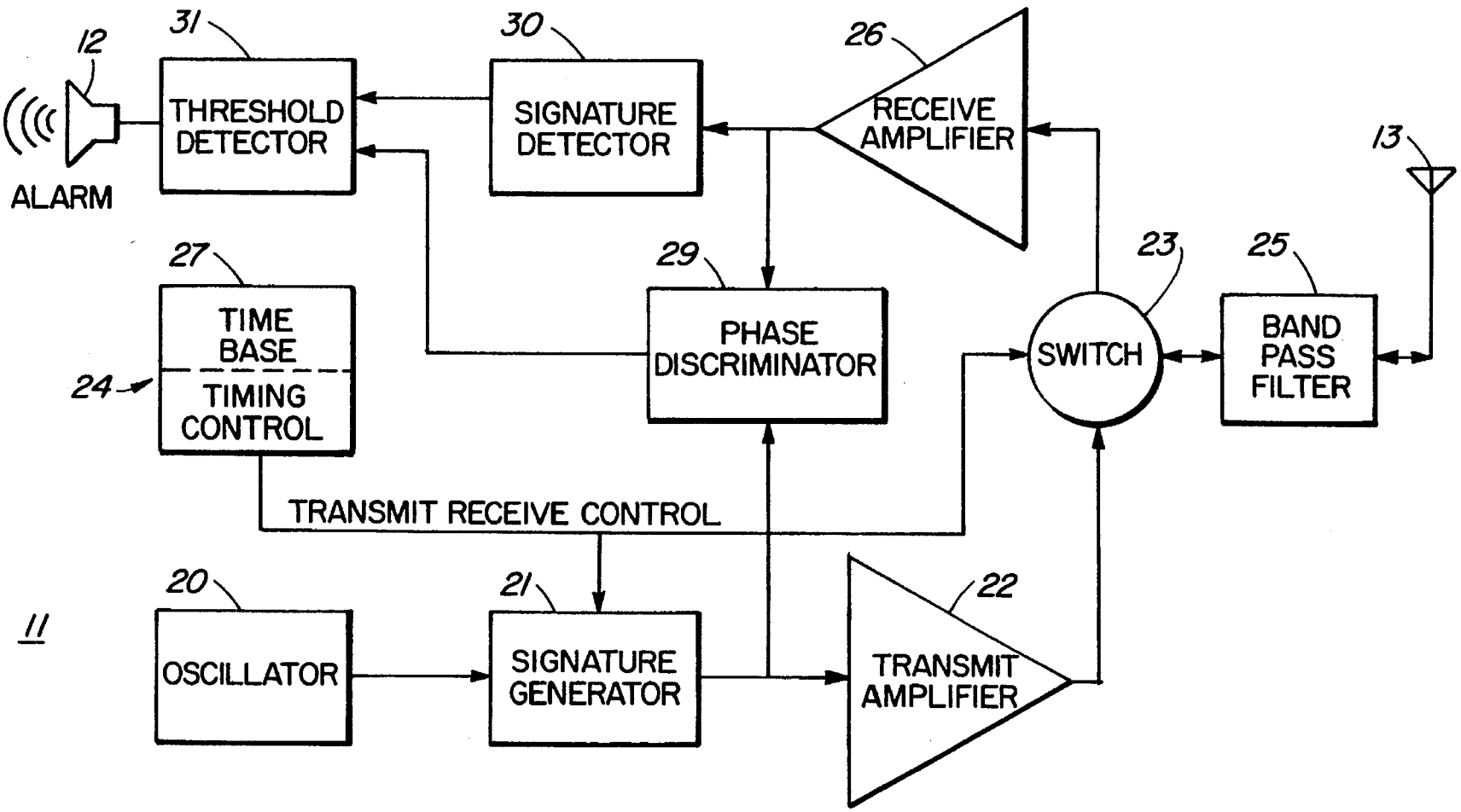
FIG. 2 is a detailed block diagram of one embodiment of a transceiver station in the system of FIG. 1.
Figure 3:
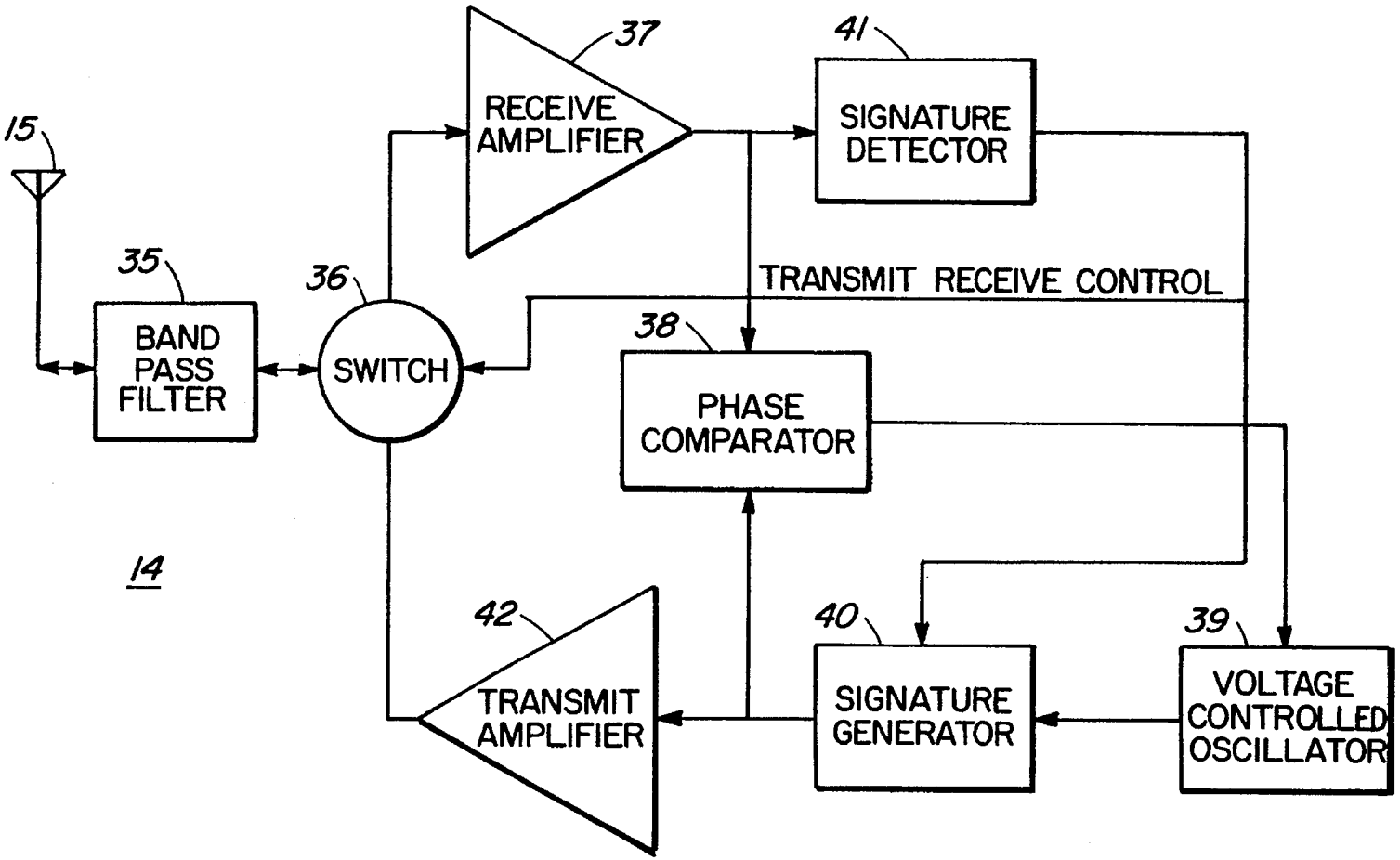
FIG. 3 is a detailed block diagram of one embodiment of a repeater station in the system of FIG. 1.

The transceiver 11 appears in FIG. 2 as a detailed block diagram and the repeater 14 is similarly shown in FIG. 3. It will be observed therefrom that circuit means are illustrated for generating and transmitting the remote signal, beginning with an rf oscillator 20 in the transceiver 11 that produces a continuous wave output signal which is input to a signature generator 21. The generator 21 is adapted to encode the input signal thereto in a predetermined manner that is recognizable to the repeater 14. An encoded signal from the generator 21 is coupled to an input of a transmit amplifier 22 and is output therefrom as the encoded remote signal which is subsequently applied to a transmit input of an analog rf switch 23 normally configured for remote signal transmission.

Since the transceiver 11 functions in a half-duplex mode, a timing control circuit 24 operates to control a duty cycle of the generator 21 to establish a transmit mode interval during which the remote signal is connected by the switch 23 to an input of a bandpass filter 25. An output of the filter 25 is connected to the antenna 13 from which the remote signal is radiated to the station 14. It will be understood, therefore, that the circuit 24 enables the generator 21 during the transmit mode and disables the generator 21 and reconfigures the switch 23 during a corresponding receive mode so that the timing signal received by the antenna 13 may be coupled through the filter 25 and connected to an input of a receive amplifier 26. A time base 27 operating at a frequency of 3.58 mHz forms part of the circuit 24 and provides appropriate timing for the duty cycle, a typical value having equal on and off times occurring at a rate of about 1 kHz.

Turning next to FIG. 3, it will be observed that the path followed by the encoded remote signal received at the antenna 15 includes a bandpass filter 35 connected to an input of a receive amplifier 37 through an analog rf switch 36 that is normally configured for remote signal reception. When the repeater 14 begins to receive the encoded remote signal from the transceiver 11, the amplifier 37 output is applied to one input of a phase comparator 38. A second input to the comparator 38 comprises an rf output signal from a voltage controlled oscillator 39 coupled through a signature generator 40. Both inputs are compared to produce an output from the comparator 38 which controls the oscillator 39 and locks the phase of its output signal to that of the received remote signal.

It will be understood that the aforedescribed circuit functions as a phase-locked loop that is implemented with a fast lock-in time and a slow delay time such that the loop retains the locked-in phase for a long period after the remote signal from the station 11 is interrupted. Thus, the phase of the timing signal transmitted at the antenna 15 is the same as the phase of the remote signal received from the transceiver 11 during its transmit mode.

The output from the amplifier 37 is also decoded by a signature detector 41 to ascertain if the remote signal is intended for the repeater 14. If recognized as such, the repeater 14 waits for the termination of transmission from the transceiver 11. Immediately upon interruption of the remote signal transmission from the transceiver 11 and consequent cessation of remote signal reception at the repeater 14, an output from the detector 41 enables the generator 40 for encoding the signal from the oscillator 39 with the same code as received. Additionally, the switch 36 is configured to connect the timing signal output from a transmit amplifier 42, driven by the generator 40, to the filter 35. The encoded timing signal is then fed to the antenna 15 for transmission to the transceiver 11.

The timing signal received at the antenna 13 follows a signal path that extends through the filter 25 and the switch 23 which is reconfigured during the transceiver 11 receive mode to couple the timing signal to the input of the amplifier 26. The output of the amplifier 26 drives both a phase discriminator 29 and a signature detector 30. During the transceiver 11 receive mode, the phase discriminator 29 measures any phase shift detected between the remote signal output from the generator 21 and the timing signal output from the amplifier 26. The result is a corresponding time shift value output from the discriminator 29 that is applied to a first input of a threshold detector 31, a second input of which receives an enabling output from the detector 30. Accordingly, upon receipt and recognition by the detector 30 of the timing signal intended for the transceiver 11, the detector 31 is enabled and the discriminator 29 output is correlated with a reference by the detector 31 which translates the time shift value into an indication of spatial separation between the transceiver 11 and repeater 14. This means that the detector 31 compares its time shift value input against a threshold value such that excessive separation between the stations, as determined by the threshold value, results in operation of the alarm 12. Any separation distances less than that represented by the threshold value do not actuate the alarm 12.

Figure 4:
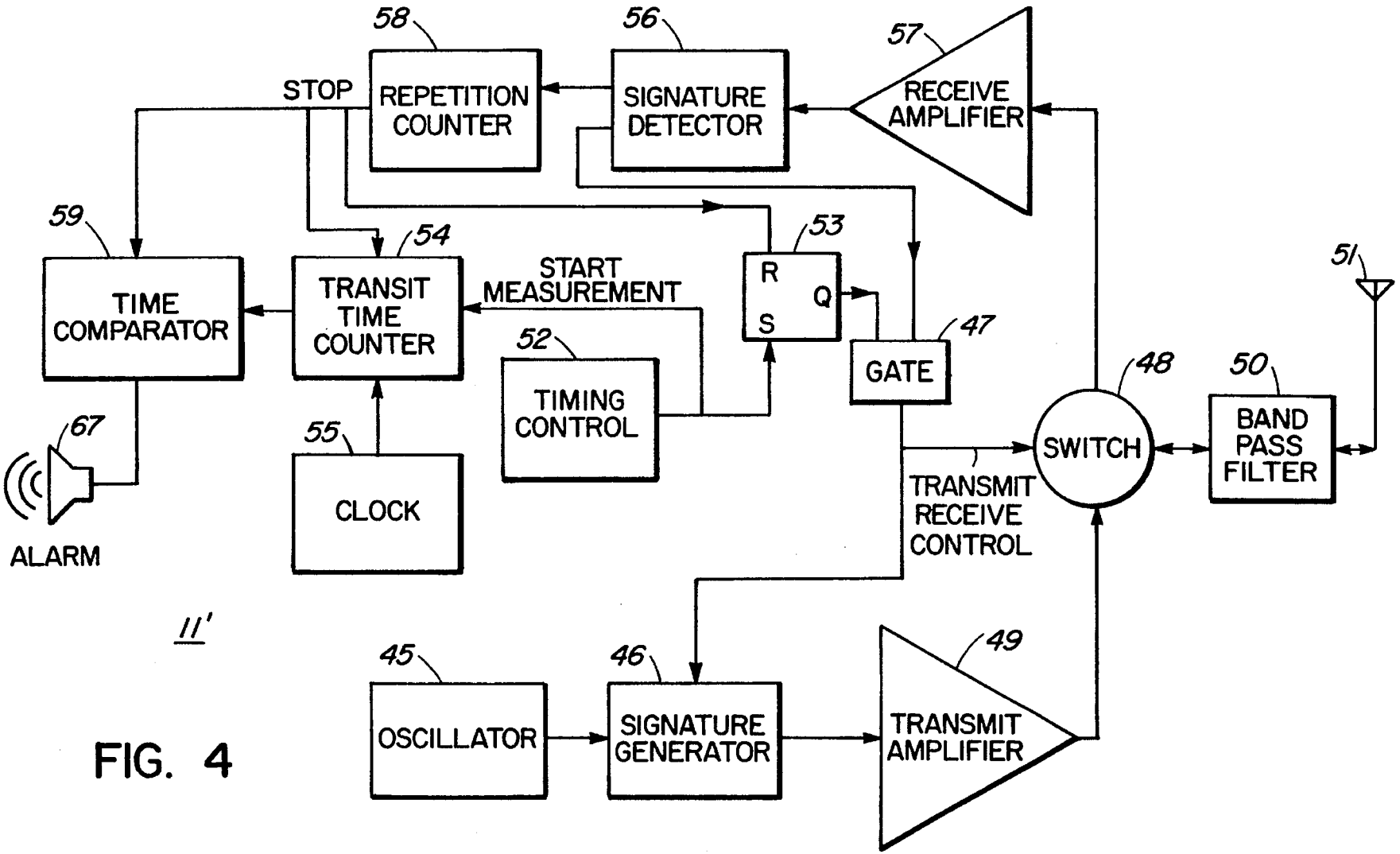
FIG. 4 is a detailed block diagram of another embodiment of a transceiver station in accordance with the invention.
Figure 5:
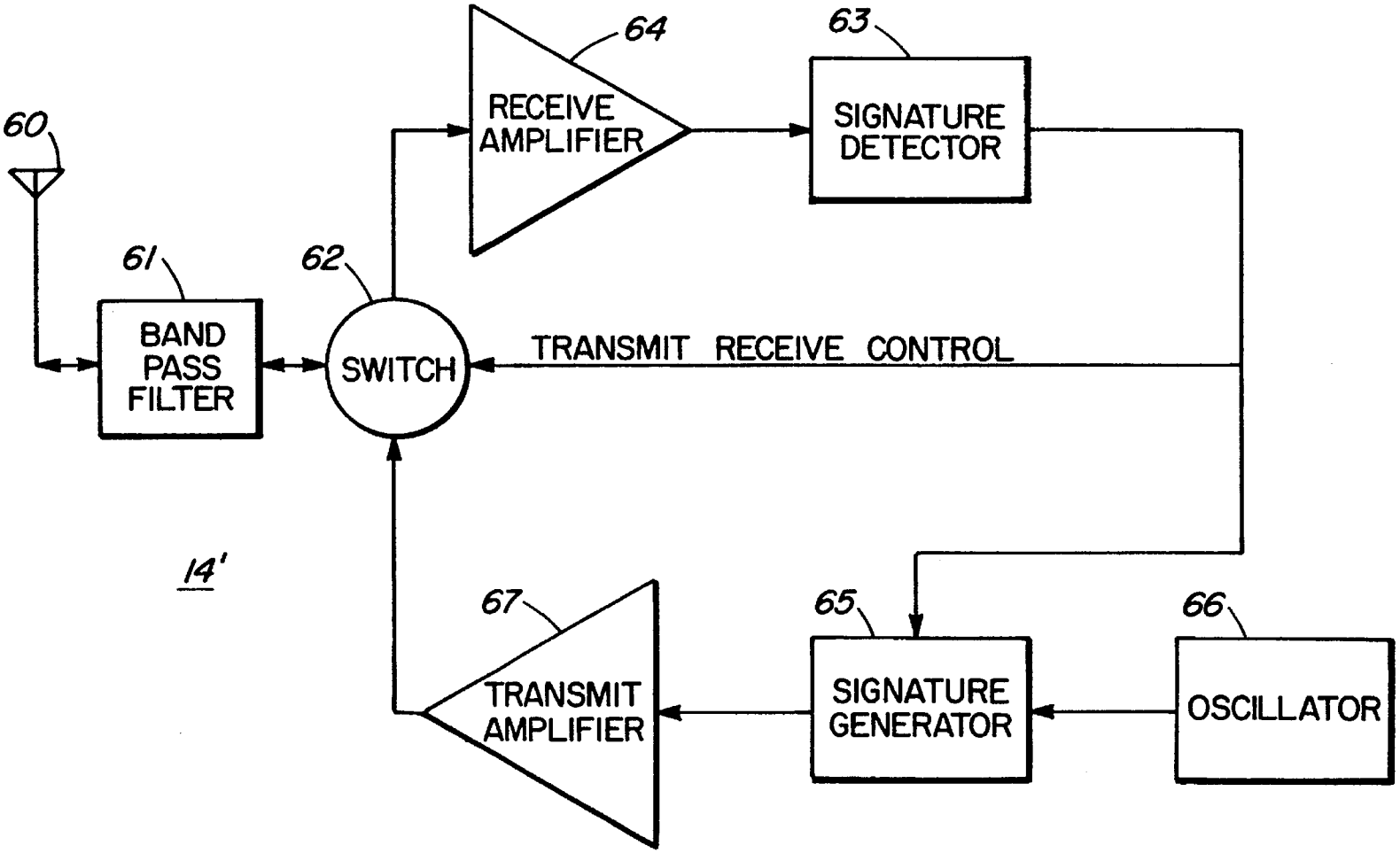
FIG. 5 is a detailed block diagram of another embodiment of a repeater station in accordance with the invention.

FIGS. 4 and 5 illustrate respective detailed block diagrams of a transceiver 11' and a repeater 14' that correspond to similarly designated components appearing in FIGS. 1–3. Much like the first described transceiver 11 illustrated in FIG. 2, an rf oscillator 45 of the transceiver 11' in FIG. 4 generates a continuous wave carrier signal coupled to a drive input of a signature generator 46 which encodes the rf carrier with a predetermined code identifying the transceiver 11'. An encoded remote signal output from the generator 46 drives a transmit amplifier 49 having an output that is coupled to a transmit input of a switch 48 which is normally configured for remote signal transmission. Accordingly, the amplifier 49 output is connected to the input of a bandpass filter 50 from which the remote signal is fed to an antenna 51 and transmitted to the repeater 14'.

During the transceiver 11' transmit mode, the repeater 14' is in its receive mode. The remote signal transmitted from the antenna 51 is therefore received at an antenna 60 of the repeater 14' from which it is coupled through a bandpass filter 61 to a receive input of an analog rf switch 62, normally configured for remote signal reception and controlled by an output of a signature detector 63. From the switch 62, the remote signal is output to a receive amplifier 64 where it is amplified and coupled to the input of the detector 63. The detector 63 output is also connected to an enabling input of a signature generator 65 that encodes an rf carrier signal coupled to a drive input thereof from an rf oscillator 66. During the receive mode of the repeater 14', it will be understood that the detector 63 disables the generator 65 until interruption of the remote signal transmission with consequent cessation of remote signal reception.

While in the receive mode, the detector 63 also decodes the remote signal to ascertain that it is indeed intended for the repeater 14'. With the remote signal correctly identified, the repeater waits for a break in transmission of the remote signal. Immediately upon interruption of the remote signal the detector 63 enables the generator 65 which encodes the signal from the oscillator 66 with the same code as received and drives the input of a transmit amplifier 67, the output of which is coupled to a transmit input of the switch 62. At this time the switch 62 is reconfigured by the detector 63 to connect the timing signal from the amplifier 67 output to the filter 61 from which the signal is fed to the antenna 60 and transmitted therefrom to the antenna 51 of the transceiver 11'.

Interruption of the transceiver 11' remote signal starts with a set pulse output from a timing control circuit 52 which is applied to a set input S of a flip-flip 53 and to an enabling input of a transit time counter 54. The counter 54 is stepped by a clock 55 operating at a rate of 20 mHz. An output Q from the flip-flop 53 comprises one input to an Exclusive OR gate 47. A second input thereto is one output of a dual output signature detector 56 that functions to decode the signature of an incoming timing signal from the repeater 14' intended for the receiver 11'.

When the transceiver 11' is first initialized, both inputs of the gate 47 are low since no timing signals have yet been received for decoding by the decoder 56 and the circuit 52 has not yet generated a set pulse. The gate 47 output is accordingly low which enables the generator 46 and places the transceiver 11' into its transmit mode. Application of a subsequently generated set pulse to the terminal S, however, causes Q to go high which in turn causes the gate 47 output to go high, thereby disabling the generator 46 and interrupting the transmission of the remote signal.

In response to remote signal interruption, a timing signal is generated by the repeater 14', transmitted and subsequently received at the antenna 51. By this time the switch 48 has been reconfigured by the output high of the gate 47 and connects the received timing signal to the amplifier 57. Signature detection by the detector 56 results in both of its outputs going high, one of which is connected to an input of the gate 47. Since both inputs of the gate 47 are high at this time, the gate output goes low which enables the generator 46 and restarts transmission of the remote signal.

Reception of the remote signal at the repeater 14' stops transmission of the timing signal, as a result of which both outputs of the detector 56 go low. Since q is still high, the gate 47 output goes high and disables the generator 46 which restarts the receive mode of the transceiver 11'. The transmit-receive modes are repeated with the second output of the detector 56 driving a repetition counter 58 so that each occurrence of a decoded timing signal intended for the transceiver 11' increments the counter 58 by one count.

An output stop pulse from the counter 58 is used to reset the R input of the flip-flop 53 and also drives inputs of the counter 54 and a time comparator 59. It should be noted, however, that the stop pulse occurs only after a predetermined number of counts n result in an overflow. When the stop signal is generated, the flip-flop 53 is reset, the counter 54 is stopped and the comparator 59 is enabled so as to compare a transit time output value from the counter 54 with a predetermined reference value set in the comparator 59. In the event that the transit time value exceeds the reference, an alarm 67 is actuated.

Resetting the flip-flop 53 causes Q to go low which takes the corresponding input of the gate 47 low. This in turn takes the gate output low during the transmit mode of the transceiver 11' when the second input of the gate 47 is also low. Therefore, in the transmit mode remote signal transmission continues until interrupted by the next set pulse generated by the circuit 52.

Should the flip-flop 53 be reset during the receive mode of the transceiver 11', Q becomes low together with its corresponding input at the gate 47. However, at this time the second input of the gate 47, taken from the detector 56, is high which brings the gate output high to maintain the disabled state of the generator 46. This results in continuous timing signal transmission until the occurrence of the next set pulse when both inputs of the gate 47 are high. The resulting gate output is then low which enables the generator 46 and restarts successive transmit-receive modes as described.

The counter 58 may be set to produce the stop pulse at any convenient value n such that n multiples of the time that the remote and corresponding timing signals take to traverse the distance between stations is measured. This feature permits accurate measurement of short distances without undue speed requirements being imposed on the circuits of the transceiver 11' and repeater 14'.

It will be apparent to those skilled in the art to whom this specification is addressed that the embodiments heretofore described may be varied to meet particular specialized requirements without departing from the true spirit and scope of the invention disclosed. For example, although the oscillators in the disclosed respective transceiver and repeater stations have been described as rf oscillators working in conjunction with other related circuitry adapted to function at radio frequency wave lengths, all of these circuits may be readily converted to function at an ultrasonic frequency. A frequency selected from the range of from 30 to 60 kHz, as a non-limiting example, may be employed with equal effect with appropriate changes being made in the supporting circuitry. One significant change here would be the substitution of radio frequency antennas with speakers adapted to function at the selected ultrasonic rate. Corresponding to an antenna, such a speaker would function comparably both as a transmitting and a receiving element, that is, a loudspeaker for transmitting signals and a microphone for receiving signals. In addition, although a loud alarm system has been disclosed as being disposed in a transceiver station, a specialized silent alarm could be used instead and the roles of the stations reversed with the transceiver station being carried by the user of the system. The foregoing embodiments are therefore not to be taken as indicative of the limits of the invention but rather as exemplary structures thereof which are described by the claims appended hereto.

The embodiments of the invention in which an exclusive property or privilege is claimed are defined as follows:

1. A proximity alarm system comprising, in combination:

a transceiver station including signal receiver means, and circuit means for generating and transmitting a remote signal encoded with a first predetermined code;

timing control means for selectively enabling the circuit means to transmit the remote signal;

a repeater station spatially separated from the transceiver station, including means for receiving the remote signal, means operably responsive to initial reception of the received remote signal for generating a timing signal encoded with a second predetermined code and means for transmitting the timing signal for reception at the transceiver station in response to cessation of the received remote signal;

decoder means at each station for identifying and accepting an encoded received signal intended for its respective station; and discriminator means for detecting a time delay between the remote and timing signals at the transceiver station and generating a time shift value in response thereto corresponding to the distance between stations.

2. A proximity alarm system as claimed in claim 1, further comprising correlation means for quantifying the time shaft value as a measure of the distance between the transceiver and repeater stations.

3. A proximity alarm system as claimed in claim 2, wherein the repeater station timing signal generator means comprise an oscillator adapted to lock the signal phase thereof in step with the received remote signal.

4. A proximity alarm system as claimed in claim 3, wherein the discriminator means comprise means for generating a control signal corresponding to the time shift value.

5. A proximity alarm system as claimed in claim 4, wherein the correlation means include means to compare the control signal with a predetermined reference.

6. A proximity alarm system as claimed in claim 5, further comprising alarm means and means for actuating the alarm means in response to the reference being exceeded by the control signal.

7. A proximity alarm system as claimed in claim 3, wherein the discriminator means comprise a phase comparator for comparing the phase relationship of the remote signal generated at the transceiver station with the received encoded timing signal and generating a phase shift value in response to a phase difference between the signals.

8. A proximity alarm system as claimed in claim 7, further comprising alarm means and wherein the correlation means include means for correlating the phase shift value with time and a reference value corresponding to a known rate of propagation for the timing signal to determine the spatial separation between the transceiver and repeater stations and further comprising means for actuating the alarm means when a predetermined spatial separation is exceeded.

9. A proximity alarm system as claimed in claim 2, wherein the transceiver station further comprises clock means and a transit time counter for incrementally counting occurrences of clock pulses over a predetermined time.

10. A proximity alarm system as claimed in claim 9, wherein the transceiver station further comprises a repetition counter for incrementally counting occurrences of decoded timing signals received at the transceiver station.

11. A proximity alarm system as claimed in claim 10, wherein the repetition counter is adapted to generate a stop signal in response to a predetermined input overflow of the decoded timing signals.

12. A proximity alarm system as claimed in claim 11, further comprising means responsive to the stop signal for disabling the transit time counter.

13. A proximity alarm system as claimed in claim 12, wherein the correlation means include means for reading the count value of the transit time counter and comparing the count value with a predetermined reference value.

14. A proximity alarm system as claimed in claim 13, further comprising alarm means and means for actuating the alarm means in response to the count value exceeding the reference value.

15. A method for operating a proximity alarm system, comprising the steps of:

generating a remote signal at a transceiver station and transmitting the signal therefrom to a remotely located repeater station;

receiving the remote signal at the repeater station;

generating a timing signal at the repeater station in response to initial reception of the received remote signal;

transmitting the timing signal from the repeater station in response to cessation of the received remote signal; and detecting a time difference between the remote signal generated and the timing signal received at the transceiver station comparing the time difference with a reference value and actuating an alarm when a predetermined time difference is exceeded.

16. A method as claimed in claim 15, comprising a preliminary step at the transceiver station of incrementally counting occurrences of clock pulses over a predetermined time.

17. A method as claimed in claim 16, comprising the preliminary step at the transceiver station of incrementally counting occurrences of decoded timing signals over the said predetermined time.

18. A method as claimed in claim 17, comprising the further step of generating a stop signal in response to a predetermined count of the decoded timing signals.

19. A method as claimed in claim 18, comprising the further step of stopping the clock pulse count in response to the stop signal.

20. A method as claimed in claim 19, comprising the further steps of:

reading the count value of the counted clock pulses;

comparing the count value with a predetermined reference value; and actuating the alarm when the count value exceeds the reference value.

* * * * *